US010916906B2

(12) United States Patent
Nicholsen et al.

(10) Patent No.: US 10,916,906 B2
(45) Date of Patent: Feb. 9, 2021

(54) ELECTRICAL CONNECTOR ASSEMBLY

(71) Applicant: Molex, LLC, Lisle, IL (US)

(72) Inventors: Austin Nicholsen, Lisle, IL (US); Alan Han, Lisle, IL (US); Victor Zaderej, Wheaton, IL (US); Kevin Simone, Bellevue, WA (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/637,272

(22) PCT Filed: Aug. 13, 2018

(86) PCT No.: PCT/US2018/046493

§ 371 (c)(1),
(2) Date: Feb. 7, 2020

(87) PCT Pub. No.: WO2019/036362

PCT Pub. Date: Feb. 21, 2019

(65) Prior Publication Data

US 2020/0251868 A1 Aug. 6, 2020

Related U.S. Application Data

(60) Provisional application No. 62/546,251, filed on Aug. 16, 2017.

(51) Int. Cl.
*H01R 39/00* (2006.01)
*H01R 35/04* (2006.01)
(Continued)

(52) U.S. Cl.
CPC ..... *H01R 35/04* (2013.01); *H01R 13/28* (2013.01); *H01R 13/501* (2013.01); *H01R 13/629* (2013.01); *H01R 43/16* (2013.01)

(58) Field of Classification Search
CPC ..... H01R 35/04; H01R 35/00; H01R 13/28; H01R 13/501; H01R 13/629; H01R 43/16
(Continued)

(56) References Cited

U.S. PATENT DOCUMENTS 7,637,745 B1 * 12/2009 Dai ..... H04M 1/0216 439/165
8,794,994 B2 * 8/2014 Kollmann ..... H01R 4/4836 439/441
(Continued)

FOREIGN PATENT DOCUMENTS

CN 101010837 A 8/2007
CN 101685936 A 3/2010
(Continued)

OTHER PUBLICATIONS

International Search report and written opinion received for PCT application No. PCT/US2018/046493, dated Dec. 4, 2018, 8 pages.

*Primary Examiner* — Khiem M Nguyen

(57) ABSTRACT

An electrical connector assembly provides a hinge between two parts, such as an eye-piece part and an arm-piece part of augmented eyewear. The assembly includes first and second hermaphroditic connectors which are rotatable relative to each other. Each connector includes a conductive electrical terminal disposed on a non-conductive support. Each electrical terminal includes a main body and a flexible contact arm extending therefrom, and a contacting protrusion protruding from the contact arm. The contact arm can be flexed into a slot in the support. The contacting protrusion on each arm maintains engagement with the main body of the other connector during rotation.

20 Claims, 11 Drawing Sheets

(51) Int. Cl.

| | |
|---|---|
| ***H01R 13/28*** | (2006.01) |
| ***H01R 13/50*** | (2006.01) |
| ***H01R 13/629*** | (2006.01) |
| ***H01R 43/16*** | (2006.01) |

(58) Field of Classification Search
USPC ..... 439/11–31
See application file for complete search history.

(56) References Cited

U.S. PATENT DOCUMENTS

| | | | | |
|---|---|---|---|---|
| 10,566,753 | B2 * | 2/2020 | De Bruijn ..... | H01R 13/629 |
| 2009/0310287 | A1 | 12/2009 | Dai et al. | |
| 2013/0157519 | A1 | 6/2013 | Ohkuma | |
| 2014/0342577 | A1 | 11/2014 | De Bruijn | |
| 2014/0370740 | A1 | 12/2014 | Kollmann et al. | |
| 2016/0044818 | A1 | 2/2016 | Bologna et al. | |

FOREIGN PATENT DOCUMENTS

| | | | |
|---|---|---|---|
| CN | 206283038 | U | 6/2017 |
| JP | 2005-518894 | A | 6/2005 |
| WO | 2017/004064 | A1 | 1/2017 |
| WO | 2019/036362 | A1 | 2/2019 |

* cited by examiner

ELECTRICAL CONNECTOR ASSEMBLY

RELATED APPLICATIONS

This application claims priority to International Application No. PCT/US2018/046493, filed on Aug. 13, 2018, which is incorporated herein by reference in its entirety and United States Provisional Application Ser. No. 62/546,251, filed on Aug. 16, 2017, which is incorporated herein by reference in its entirety.

TECHNICAL FIELD

This disclosure relates to the field of an electrical connector assembly and, more specifically, to an electrical connector assembly having a hinged element.

DESCRIPTION OF RELATED ART

Electrical connector assemblies having a hinged element are suitable for use between at least two elements that rotate with respect to each other while maintaining electrical contact between the two elements during and after rotation. These types of connector assemblies are typically used with rotating hinged displays, slip rings that typically utilize a rotating contact ring and a deflectable contact.

SUMMARY

An electrical connector assembly provides a hinge between two parts, such as an eye-piece part and an arm-piece part of augmented eyewear. The assembly includes first and second hermaphroditic connectors which are rotatable relative to each other. Each connector includes a conductive electrical terminal disposed on a non-conductive support. Each electrical terminal includes a main body and a flexible contact arm extending therefrom, and a contacting protrusion protruding from the contact arm. The contact arm can be flexed into a slot in the support. The contacting protrusion on each arm maintains engagement with the main body of the other connector during rotation.

This Summary is provided merely for purposes of summarizing some example embodiments so as to provide a basic understanding of some aspects of the disclosure. Accordingly, it will be appreciated that the above described example embodiments are merely examples and should not be construed to narrow the scope or spirit of the disclosure in any way. Other embodiments, aspects, and advantages of various disclosed embodiments will become apparent from the following detailed description taken in conjunction with the accompanying drawings which illustrate, by way of example, the principles of the described embodiments.

DETAILED DESCRIPTION

Figure 1:
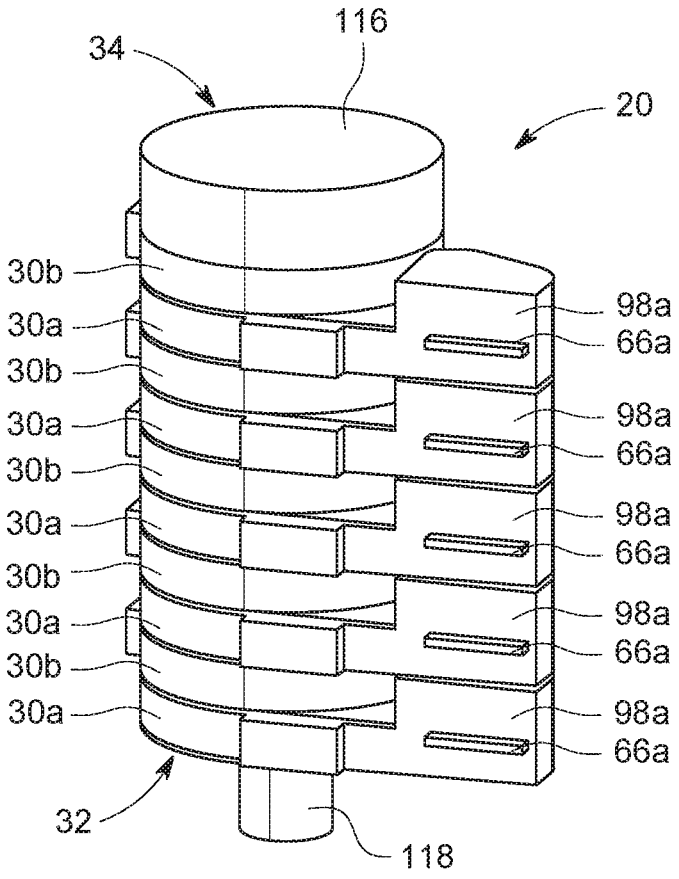
FIG. 1 is a perspective view of an electrical connector assembly in accordance with an embodiment of the present disclosure.
Figure 2:
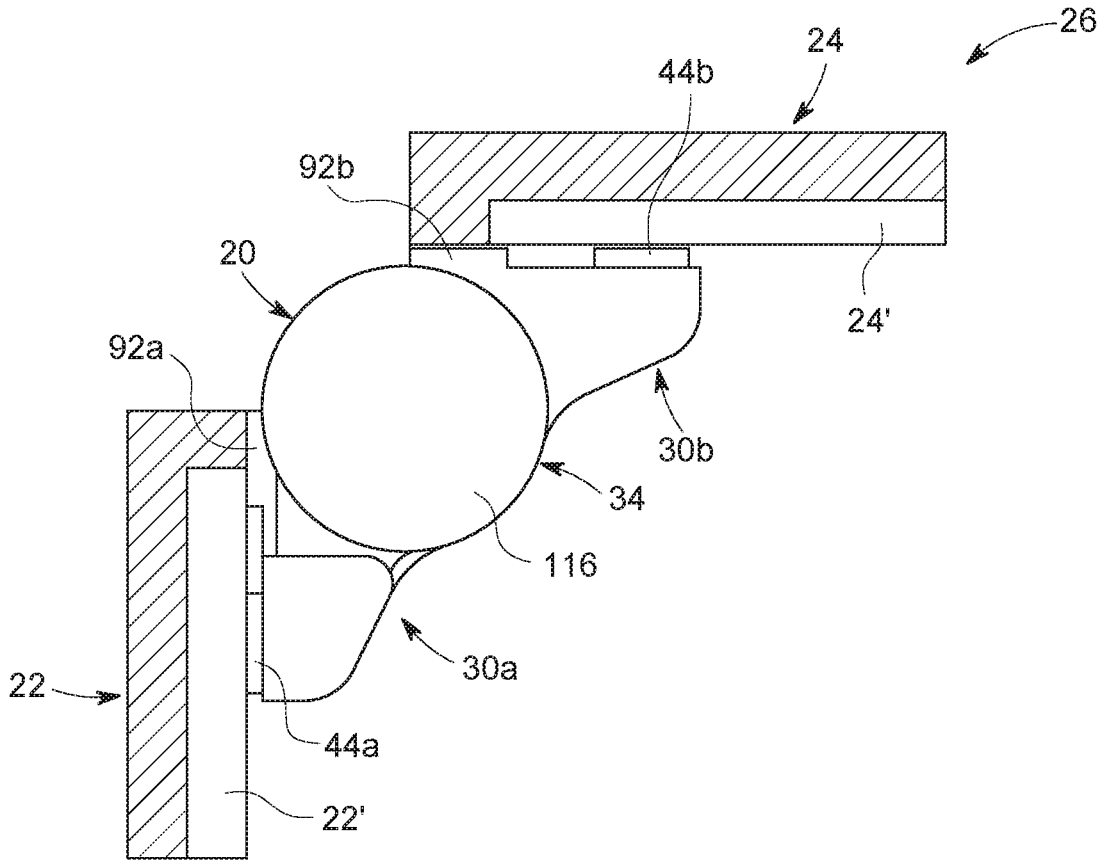
FIG. 2 is a top plan view of the electrical connector assembly assembled with a device.
Figure 3:
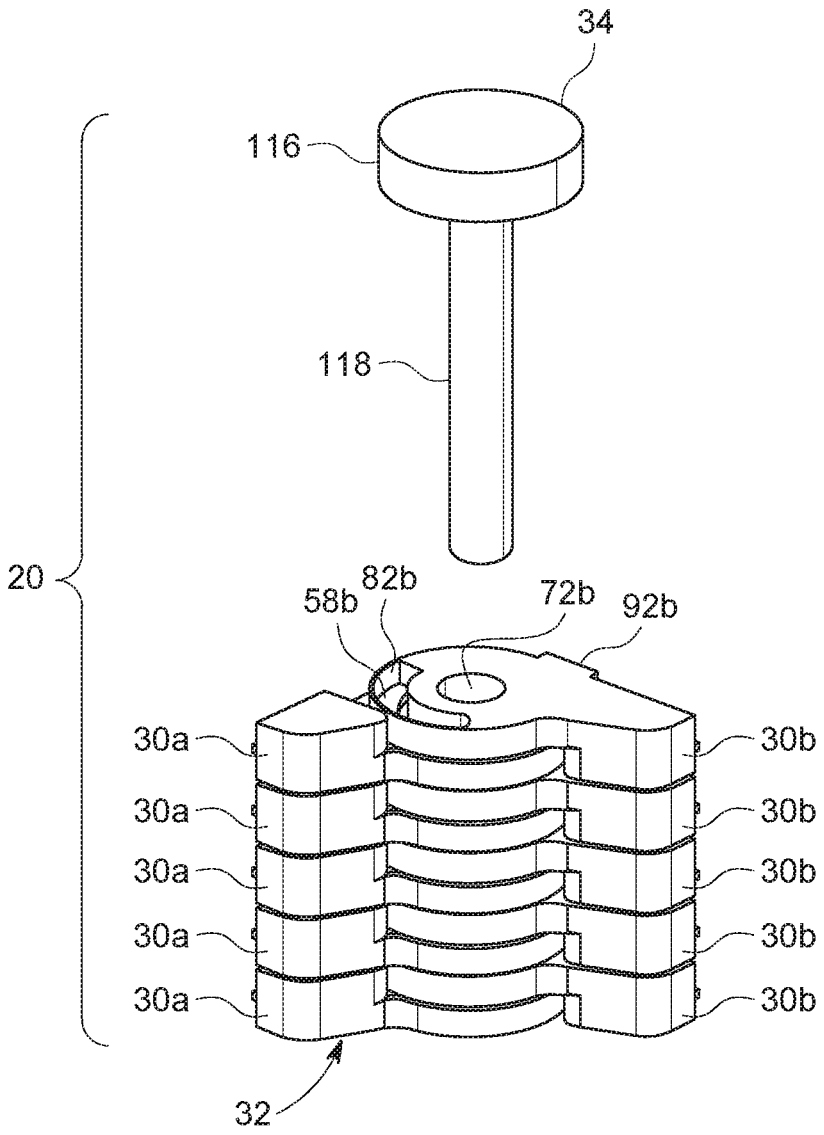
FIG. 3 is a partial exploded perspective view of the electrical connector assembly.
Figure 4:
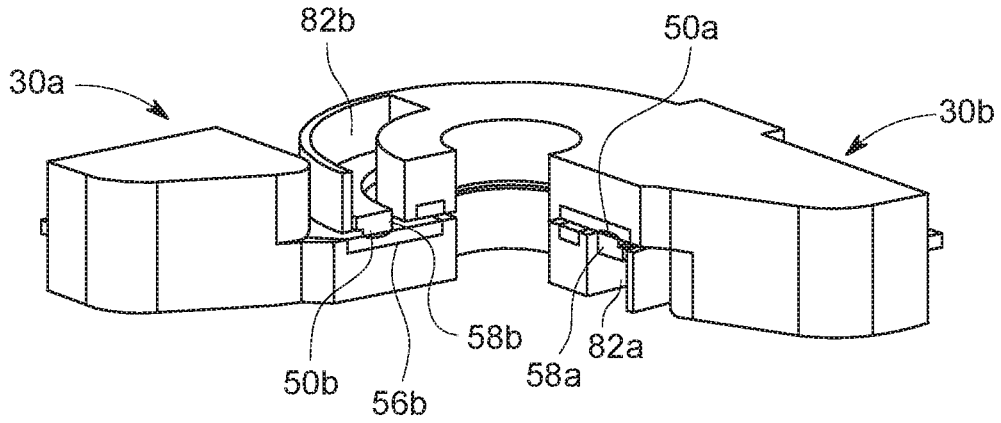
FIG. 4 is a partial cross-sectional view of a pair of connectors of the electrical connector assembly.

While the disclosure may be susceptible to embodiment in different forms, there is shown in the drawings, and herein will be described in detail, specific embodiments with the understanding that the present disclosure is to be considered an exemplification of the principles of the disclosure and is not intended to limit the disclosure to that as illustrated and described herein. Therefore, unless otherwise noted, features disclosed herein may be combined to form additional combinations that were not otherwise shown for purposes of brevity. It will be further appreciated that in some embodiments, one or more elements illustrated by way of example in a drawing(s) may be eliminated and/or substituted with alternative elements within the scope of the disclosure.

An electrical connector assembly 20 is provided to form a hinge between two parts 22, 24 of a device 26. Each part 22, 24 of the device 26 has electrical components 22', 24' thereon, and the electrical connector assembly 20 provides an electrical connection between the electrical components 22', 24' on the two parts 22, 24 while allowing the parts 22, 24 to rotate relative to each other. As shown in the drawings, the device 26 is shown as augmented eyewear. It is to be understood that the drawings illustrate an embodiment of the present disclosure and it is to be understood that the disclosed embodiment is merely exemplary of the disclosure, which may be embodied in various forms. Therefore, specific details disclosed herein are not to be interpreted as limiting, but merely as a basis for the claims and as a representative basis for teaching one skilled in the art to variously employ the present disclosure. For example, the device 26 could be provided as part of a car (for example, the electrical connector assembly 20 providing a hinge for the car door), as part of an appliance (for example, the electrical connector assembly 20 providing a hinge for the appliance door), etc.

The electrical connector assembly 20 includes at least one pair of connectors 30*a*, 30*b* that are arranged in a vertical stacked relationship to form a connector stack 32, and a hinge pin 34 extending through the connector stack 32 and around which the at least one pair of connectors 30*a*, 30*b* can rotate. The connector 30*a*, 30*b* in each pair can rotate relative to each other around the hinge pin 34. Connector(s) 30*a* are affixed to and electrically connected to part 22, and connector(s) 30*b* are affixed to and electrically connected to part 24. While five pairs of connectors 30*a*, 30*b* are shown, more or less than five pairs of connectors 30*a*, 30*b* may be provided, The number of pairs of connectors 30*a*, 30*b* can be adjusted according to a desired number of circuits required for the functional features needed in the device 26.

Each connector 30*a*, 30*b* is identical and the connectors 30*a*, 30*b* are arranged in an alternating mirrored relationship, and therefore, a single connector 30*a* is described, with the understanding that the other connectors 30*b* have the same reference numeral for the identical features, but are shown with the suffix "b". The connector 30*a* includes an electrical terminal 36*a* and a housing or support 38*a* on which the electrical terminal 36*a* is mounted.

Figure 5:
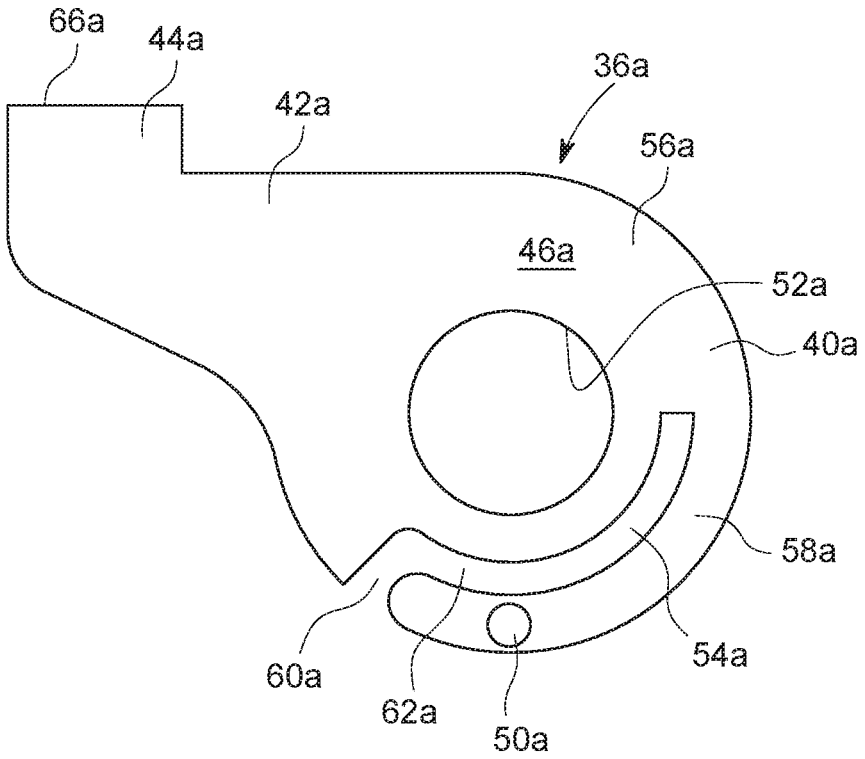
FIG. 5 is a top plan view of an electrical terminal of the electrical connector assembly.
Figure 7:
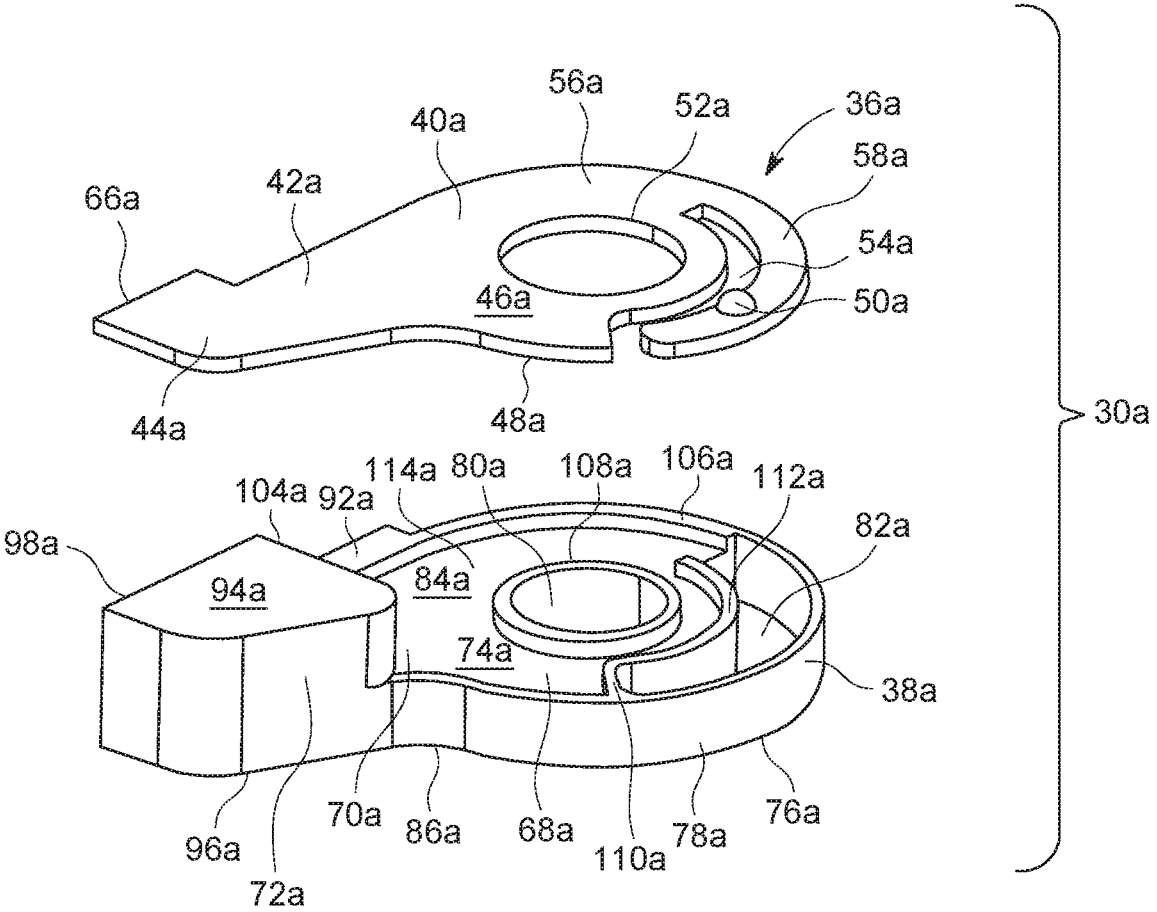
FIG. 7 is an exploded perspective view of a connector of the electrical connector assembly.
Figure 8:
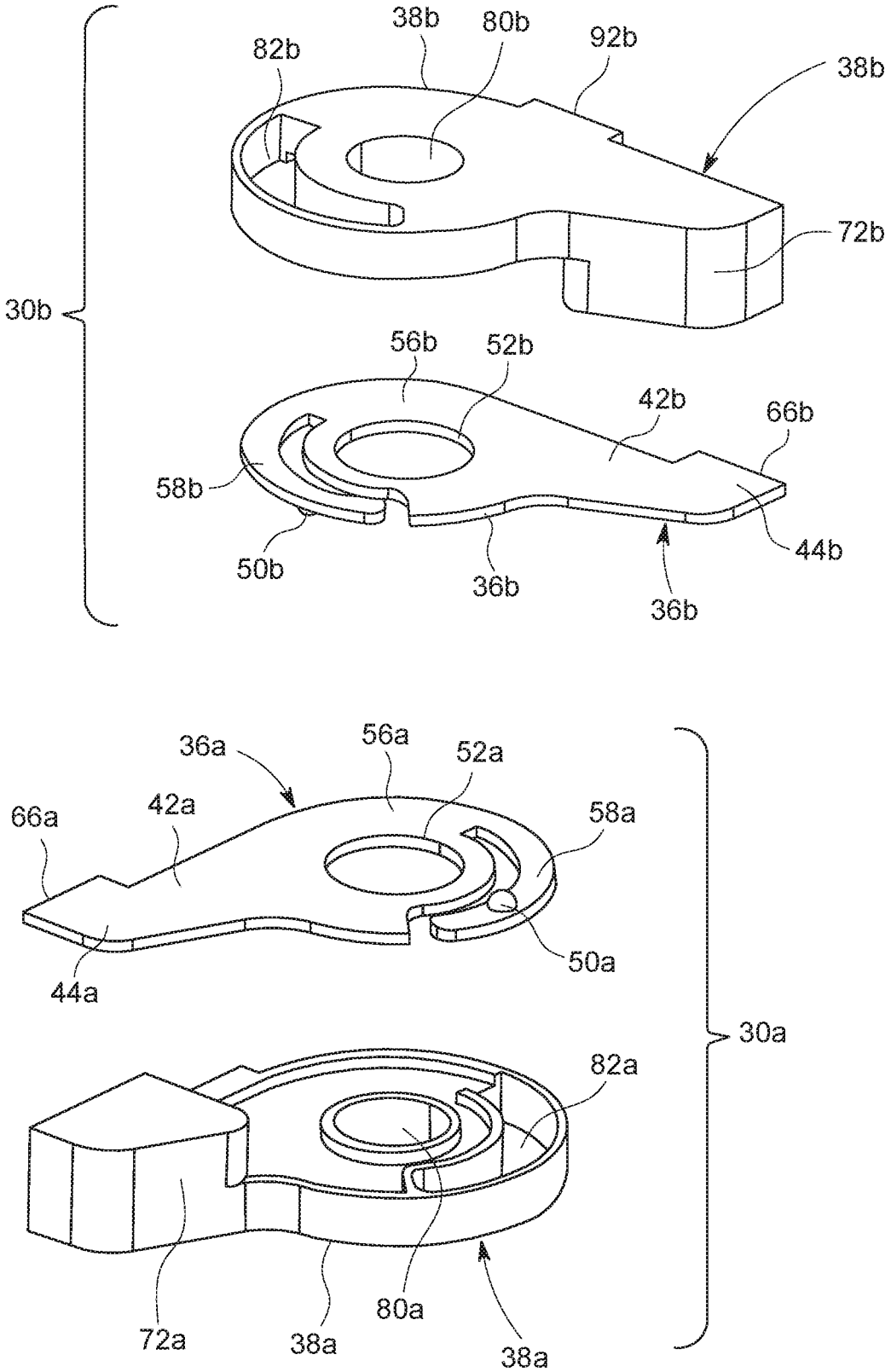
FIG. 8 is an exploded perspective view of a pair of connectors of the electrical connector assembly.

The electrical terminal 36*a* is formed of an electrically conductive material. The electrical terminal 36*a* may be formed by a stamping and forming. The electrical terminal 36*a* may be formed from a resilient electrically conductive flat stock, generally copper or copper-based alloy. As best shown in FIGS. 5 and 7, the electrical terminal 36*a* has a base section 40*a*, a mounting section 42*a* extending from the base section 40*a*, and a tab section 44*a* extending from the mounting section 42*a*.

The base section 40*a* has a first surface 46*a* and a second, opposite surface 48*a*. In an embodiment, the surfaces 46*a*, 48*a* are planar, with the exception of a contacting projection 50*a* discussed herein. In an embodiment, the base section 40*a* is circular in configuration. An aperture 52*a* is formed through the base section 40*a* between the surfaces 46*a*, 48*a*, and in an embodiment, the aperture 52*a* is formed in a center of the base section 40*a*, An elongated slot 54*a* is formed in the base section 40*a* between the surfaces 46*a*, 48*a* to divide the base section 40*a* into a main body 56*a* and a contact arm 58*a*. The elongated slot 54*a* includes an entrance portion 60*a* having an outer end that extends from an outer periphery of the base section 40*a* and an extending portion 62*a* which extends from an inner end of the entrance portion 60*a*. In an embodiment, the entrance portion 60*a* extends radially relative to a center of the base section 40*a*, and the extending portion 62*a* follows an arcuate shape that is radially spaced from the center of the base section 40*a*. The contact arm 58*a* is thus cantilevered from the main body 56*a* such that a first end of the contact arm 58*a* is integrally formed with the main body 56*a* and a second end of the contact arm 58*a* is free. In an embodiment, the contact arm 58*a* is curved. The contacting projection 50*a* extends from the first surface 46*a* of the contact arm 58*a* along its length. In an embodiment, the contacting projection 50*a*. extends from the contact arm 58*a* at a position which is proximate to, but spaced from, the second free end. The slot 54*a* allows the contact arm 58*a* to flex relative to the main body 56*a*.

The mounting section 42*a* extends outwardly from the base section 40*a*. The mounting section 42*a* has a first surface and a second, opposite surface. In an embodiment, the surfaces are planar. The mounting section 42*a* may extend from an opposite side of the base section 40*a* from which the contact arm 58*a* is provided. In an embodiment, the mounting section 42*a* has a first end at the base section 40*a* which is wider than a second opposite end of the mounting section 42*a*.

The tab section 44*a* extends outwardly from the second end of the mounting section 42*a* to a free end 66*a*. The tab section 44*a* has a first surface and a second, opposite surface. In an embodiment, the surfaces are planar. In an embodiment, the tab section 44*a* is angled relative to the mounting section 42*a*. In an embodiment, the tab section 44*a* is perpendicular to the mounting section 42*a*.

In an embodiment, the first surfaces of the base section 40*a*, the mounting section 42*a* and the tab section 44*a* are co-planar with each other when the contact arm 58*a* is unflexed, with the exception of the contacting projection 50*a*, and the second surfaces of the base section 40*a*, the mounting section 42*a* and the tab section 44*a* are co-planar with each other when the contact arm 58*a* is unflexed.

Figure 6:
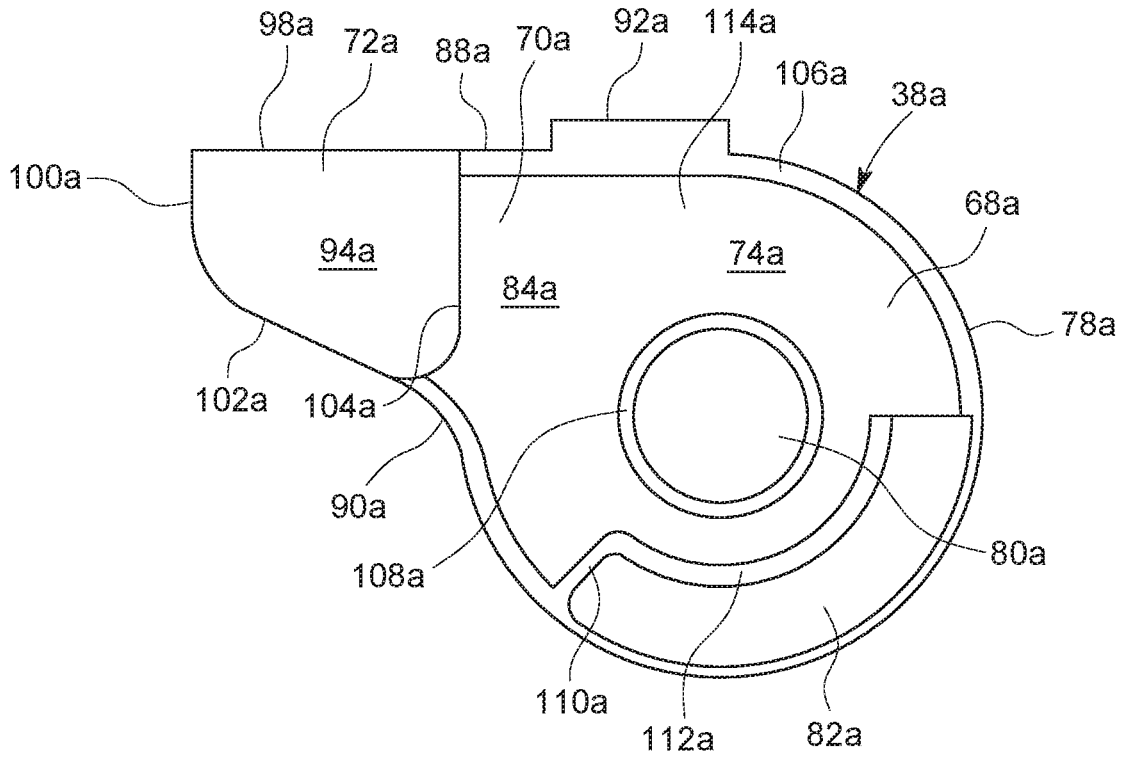
FIG. 6 is a top plan view of a support of the electrical connector assembly.

The support 38*a* is formed over/around the electrical terminal 36*a* in order to provide protection and support to the electrical terminal 36*a*. The support 38*a* is formed of a non-conductive material. As best shown in FIGS. 6 and 7, the support 38*a* has a base section 68*a*, a mounting section 70*a* extending from the base section 68*a*, and a tab section 72*a* extending from the mounting section 70*a*.

The base section 68*a* has a first surface 74*a*, a second, opposite surface 76*a* and a side surface 78*a* extending therebetween. In an embodiment, the surfaces 74*a*, 76*a* are planar. An aperture 80*a* is formed through the base section 68*a* between the surfaces 74*a*, 76*a*, and in an embodiment, the aperture 80*a* is formed in a center of the base section 68*a*. In an embodiment, the base section 68*a* is circular in configuration and slightly larger than the base section 40*a*. An elongated slot 82*a* is formed though the base section 68*a*, extends between the surfaces 74*a*, 76*a*, and is dimensioned such that the contact arm 58*a* can pass therein. The slot 82*a* has first and second ends, with an outer side wall extending between the ends, and an inner side wall extending between the ends. In an embodiment, the slot 82*a* is radially spaced from a center of the base section 68*a* and follows an arcuate shape. In an embodiment, the elongated slot 82*a* mirrors the shape of the contact arm 58*a* but is slightly larger than the contact arm 58*a*.

The mounting section 70*a* extends outwardly from the base section 68*a*. The mounting section 70*a* has a first surface 84*a*, a second, opposite surface 86*a* and side surfaces 88*a*, 90*a* extending therebetween. In an embodiment, the first and second surfaces 84*a*, 86*a* are planar. The mounting section 70*a* may extend from an opposite side of the base section 68*a* from which slot 82*a* is provided. In an embodiment, the mounting section 70*a* has a first end at the base section 68*a* which is wider than a second opposite end of the mounting section 70*a*. In an embodiment, the first surfaces 74*a*, 84*a* of the base section 68*a* and the mounting section 70*a* are co-planar with each other and the second surfaces 76*a*, 86*a* of the base section 68*a* and the mounting section 70*a* are co-planar with each other, A flange 92*a* extends outwardly from the side surface 88*a* of the mounting section 70*a* and may extend between the first and second surfaces 84*a*, 86*a* of the mounting section 70*a*.

The tab section 72*a* has a first surface 94*a*, a second, opposite surface 96*a* and side surfaces 98*a*, 100*a*, 102*a* extending therebetween. In an embodiment, the first and second surfaces 94*a*, 96*a* are planar. The side surface 98*a* may be co-planar with side surface 88*a*. A first end of the tab section 72*a* extends from the second end of the mounting section 70*a*, In an embodiment, the first surface 94*a* of the tab section 72*a* is offset from the first surfaces 74*a*, 84*a* of the base section 68*a* and the mounting section 70*a* such that the tab section 72*a* has a greater height than the base section 68*a* and a shoulder wall 104*a* is formed at the junction with the mounting section 70*a*, In an embodiment, the second surfaces 76*a*, 86*a*, 96*a* of the base section 68*a*, the mounting section 70*a* and the tab section 72*a* are co-planar with each other.

A first wall 106*a* extends from the first surfaces 74*a*, 84*a* at the outer periphery of the base section 68*a* and the mounting section 70*a* and extends from the shoulder wall 104*a*, a second wall 108*a* extends from the first surface 74*a* of the base section 68*a* around the aperture 80*a*, a third wall 110*a* extends from the first surface 84*a* of the base section 68*a* and is proximate to the second end of the slot 82*a*, and a fourth wall 112*a* extends from the first surface 74*a* of the base section 68*a* and is proximate to the inner side wall of the slot 82*a*. The third wall 110*a* extends inwardly from the first wall 106*a* and the fourth wall 112*a* extends from an inner end of the third wall 110*a*. In an embodiment, the third wall 110*a* extends radially relative to the center of the base section 68*a*, and the fourth wall 1 12*a* follows an arcuate shape that is radially spaced from the center of the base section 68*a*. The third wall 110*a* is dimensioned to fit within the entrance portion 60*a* of the slot 54*a* in the electrical terminal 36*a*, and the fourth wall 112*a* is dimensioned to fit within the extending portion 62*a* of the slot 54*a* in the electrical terminal 36*a*. The walls 104*a*, 106*a*, 108*a*, 110*a*, 112*a* form a recess 114*a* in the support 38*a*. The shoulder wall 104*a* may have a greater height than the walls 106*a*, 108*a*, 110*a*, 112*a*. The walls 106*a*, 108*a*, 110*a*, 112*a* may have the same height or varying heights.

Figure 9:
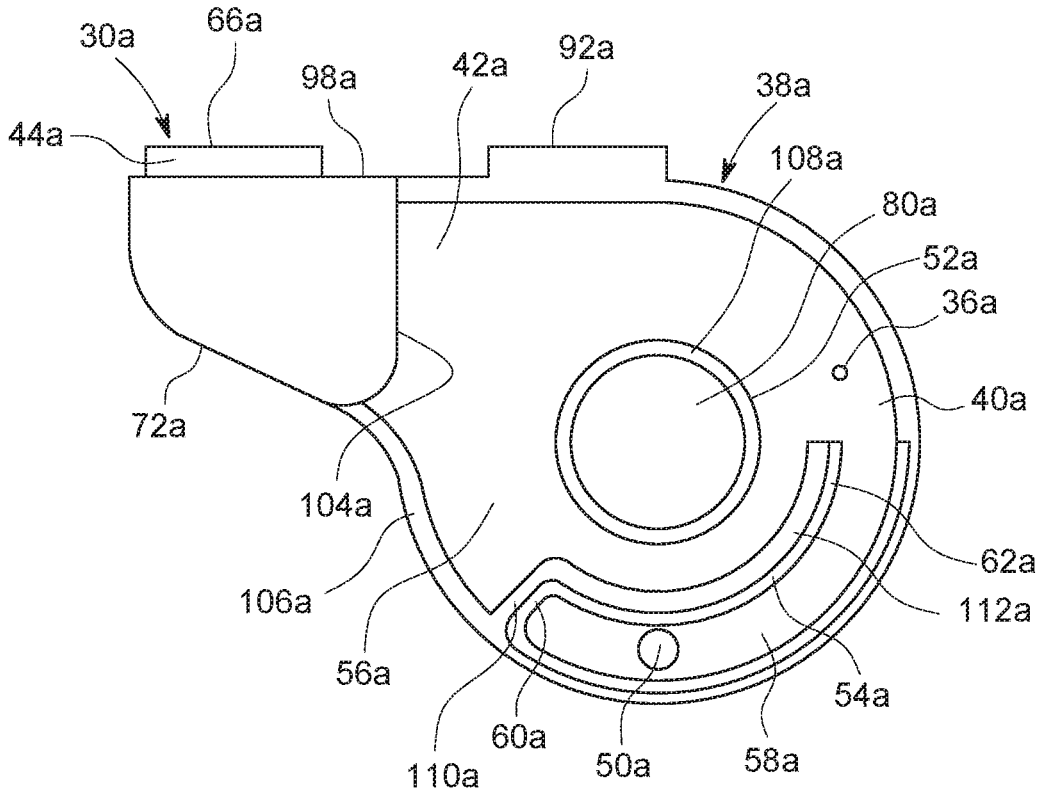
FIG. 9 is a top plan view of one of the connectors of the electrical connector assembly.

The electrical terminal 36*a* is mounted to the support 38*a* as shown in FIG. 9. The base section 40*a* of the electrical terminal 36*a* is seated within the recess 114*a*. The third wall 110*a* of the support 38*a* seats within the entrance portion 60*a* of the slot 54*a* in the electrical terminal 36*a*, the fourth wall 112*a* of the support 38*a* seats within the extending portion 62*a* of the slot 54*a* in the electrical terminal 36*a*, and the contact arm 58*a* is positioned over the slot 82*a*. The second wall 108*a* of the support 38*a* seats within the aperture 52*a* in the electrical terminal 36*a*. The mounting section 42*a* of the electrical terminal 36*a* seats partially within the recess 114*a*. and extends partially through the tab section 72*a* of the support 38*a*, The tab section 44*a* of the electrical terminal 36*a* extends partially through the tab section 72*a* of the support 38*a* and the end 66*a* of the tab section 44*a* of the electrical terminal 36*a* extends outwardly from the side surface 98*a* of the tab section 72*a* of the support 38*a*, thereby exposing a portion of the tab section 44*a* of the electrical terminal 36*a* on the exterior of the support 38*a*. The flange 92*a* extends outwardly from the mounting section 70*a* on the same side of the connector 30*a* as where the tab section 72*a* extends.

The connectors 30*a*, 30*b* are vertically stacked on each other to form pairs of connectors 30*a*, 30*b*, In each pair, the electrical terminals 34*a*, 34*b* face each other and the contacting projection 50*a* on the connector 30*a* contacts the base section 40*b* of the connector 30*b* and is in electrical engagement therewith, and the contacting projection 50*b* on the connector 30*b* contacts the base section 40*a* of the connector 30*a* and is in electrical engagement therewith. The slots 82*a*, 82*b* allow the contact arms 58*a*, 58*b* to flex. The apertures 52*a*, 80*a*, 52*b*, 80*b* align with each other to form a passageway and define an axis around which the connectors 30*a*, 30*b* rotate. In this arrangement, each connector 30*a*, 30*b* is positioned in an alternating mirrored relationship, in other words, a hermaphroditic arrangement, wherein each electrical terminal 36*a*, 36*b* faces, and is exposed to, the other electrical terminal 36*a*, 36*b* of the connector 30*a*, 30*b* in the pair.

The hinge pin 34 extends through the aligned apertures 52*a*, 80*a*, 52*b*, 80*b* and is secured to the pair of connectors 30*a*, 30*b* (and any remaining pairs 30*a*, 30*b* when provided). The hinge pin 34 includes an enlarged head 116 with a post 118 extending from the head 116. The post 118 of the hinge pin 34 is disposed in the aligned apertures 52*a*, 80*a*, 52*b*, 80*b* securing the adjacent connectors 30*a*, 30*b* together. The post 118 of the hinge pin 34 engages the walls forming the apertures 80*a*, 80*b* in the supports 38*a*, 38*b* such that any lateral or side loads are applied to the supports 38*a*, 38*b* of the connectors 30*a*, 30*b* rather than to the electrical terminals 36*a*, 36*b* of the connectors 30*a*, 30*b*, A fastener (not shown) may be provided on the end of the post 118 to secure the hinge pin 34 to the connector stack 32. The end of the post 118 may be swaged to secure the hinge pin 34 to the connector stack 32.

In each pair of connectors 30*a*, 30*b*, the tab section 44*a* of the electrical terminal 36*a* is electrically connected to the electrical components 22' in the first part 22 of the device 26 and the flange 92*a* seats against the first part 22 of the device 26; and the tab section 44*b* on the second connector 30*b* is electrically connected to the electrical components 24' in the second part 24 of the device 26 and the flange 92*b* seats against the second part 24 of the device 26. Adjacent pairs of the connectors 30*a*, 30*b* have the second surfaces 76*a*, 76*b* of the supports 38*a*, 38*b* facing each other. The tab sections 44*a*, 44*b* are configured to be surface mounted to the electrical components 22', 24' which may be formed as rigid or flexible circuit boards in each part 22, 24. The stacked connectors 30*b*, 30*b* are interleaved together in the connector stack 32.

In operation, one connector rotates with respect to the other connector, for example connector 30*a* rotates with respect to connector 30*b*, and the contacting projection 50*a* is biased to the main body 56*b* of the opposing terminal 36*b*. The contacting projection 50*a* rides on the main body 56*b* and deflects the contact arm 58*a* in an axial direction away from the point of contact and into the corresponding slot 82*a* formed in the support 38*a*, and therefore causing a reactionary or normal force between the contacting projection 50*a* on the electrical terminal 36*a* on the connector 30*a* and the base section 40*b* of the electrical terminal 36*b* of the connector 30*b*, and contacting projection 50*b* rides on the main body 56*a* and deflects the contact arm 58*b* in an axial direction away from the point of contact and into the corresponding slot 82*b* formed in the support 38*b*, and therefore causing a reactionary or normal force between the contacting projection 50*b* on the electrical terminal 36*b* on the connector 30*b* and the base section 40*a* of the electrical terminal 36*a* of the connector 30*a*, thereby maintaining constant electrical engagement between the connectors 30*a*, 30*b* at all times during rotation.

As shown in the drawings, the electrical connector assembly 20 is shown in a 90-degree arrangement so that in operation, when the device 26 is in the open position and moved to the closed or folded position, the electrical connector assembly 20 operates between a 90-degree position and a 0-degree position respectively. In other arrangements, the electrical connector assembly 20 can be operated with a 180-degree to 90-degree stroke. In this case, the electrical connector assembly 20 would be flat or in-line at 180-degrees in the open position and at 90-degrees in the folded or closed position. Other angular strokes and range of movements are contemplated within the scope of the disclosure and not limited to the illustrated examples.

Figure 10:
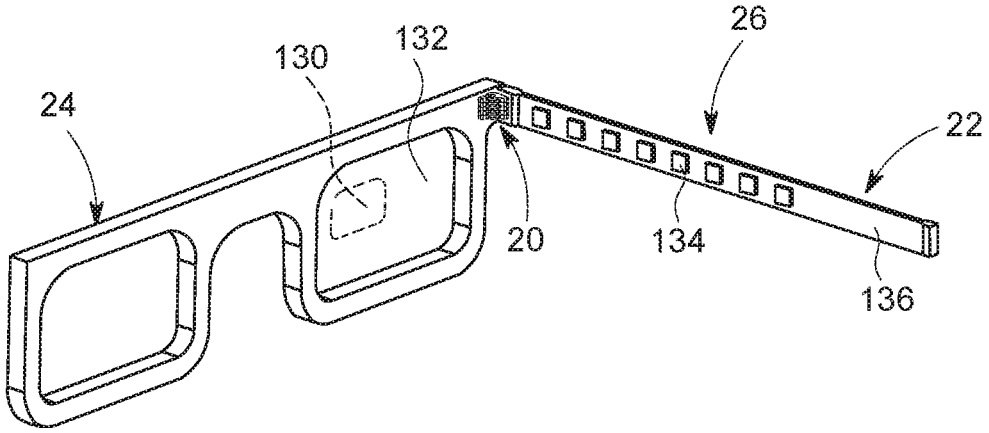
FIG. 10 is a perspective view of augmented eyewear which includes the electrical connector assembly.
Figure 11:
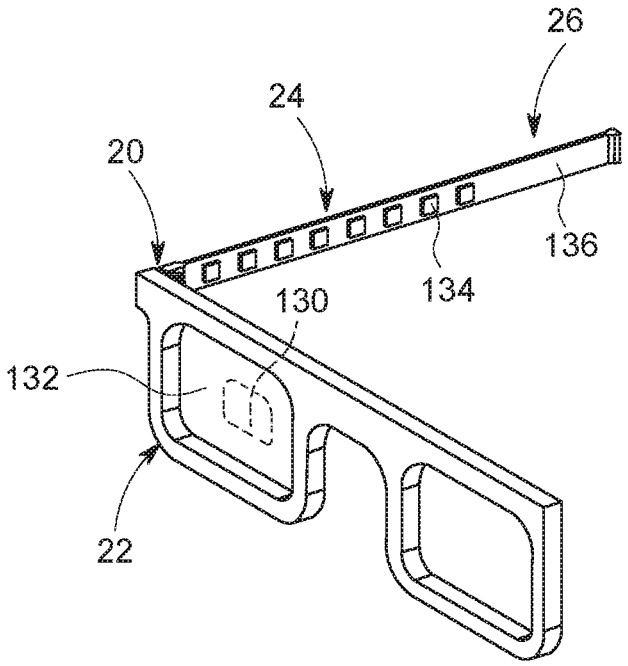
FIG. 11 is an alternate perspective view of the augmented eyewear of FIG. 9.

As shown in FIGS. 10 and 11, the device 26 is augmented eyewear and the first part 22 is an eye-piece part and the second part 24 is an arm-piece part. A second arm-piece part is typically also provided, but may have a different hinge as an electrical connection may not be needed. Typically, augmented eyewear includes a display device 130 that is incorporated either into a lens 132 or in proximity to the lens 132 on the eye-piece part, and the associated electrical components 134 to drive the display device 130 are arranged on one of the arm-piece parts. The second part 24 formed by the arm-piece part includes an arm base 136 with associated electrical components 134 mounted thereon. The arm base 136 may include the electrical component 24' for mounting the electrical components 134 or the electrical components 134 may be directly mounted on the arm base 136 in a MID (Molded Interconnect Device) structure. Additionally, some embodiments include an Application Specific Electronics Packaging ("ASEP") system, which enables the manufacture of additional products using reel to reel (continuous flow) manufacturing processes as opposed to the "batch" processes used to currently manufacture electronic products. Through certain ASEP embodiments, it is possible to integrate connectors, sensors, LEDs, thermal management, antennas, RFID devices, microprocessors, memory, impedance control, and multi-layer functionality directly into the device. Reference to ASEP packaging systems and methods are described in PCT publication WO1700406A1 owned by Molex, LLC. It can be appreciated that the eyewear depicted in the drawings is purely illustrative and encompasses the minimum structure that illustrates the functionality of the eyewear. Style considerations and other human effect features are purposely not included in the description and the lack therefore is not limiting.

While particular embodiments are illustrated in and described with respect to the drawings, it is envisioned that those skilled in the art may devise various modifications without departing from the spirit and scope of the appended claims. It will therefore be appreciated that the scope of the disclosure and the appended claims is not limited to the specific embodiments illustrated in and discussed with respect to the drawings and that modifications and other embodiments are intended to be included within the scope of the disclosure and appended drawings. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure and the appended claims.

We claim:

1. An electrical connector assembly configured to provide a hinge between electrical components on two parts, comprising:

a first connector and a second connector, the connectors being hermaphroditic, each connector including a conductive electrical terminal and a non-conductive support on which the electrical terminal is disposed, the electrical terminal including a main body and a contact arm extending therefrom, and a contacting protrusion extending from the contact arm, wherein the contact arm can be flexed relative to the main body, the support having a slot therethrough, the contact arm being proximate to the slot such that the contact arm can be flexed into the slot; and a hinge pin extending through the connectors, the connectors being rotatable around hinge pin, wherein when the first connector is mated with the second connector, the contacting protrusion of the first connector engages with the main body of the second connector and the contacting protrusion of the second connector engages with the main body of the first connector, and wherein during rotation of the connectors relative to each other, the contacting protrusion of the first connector maintains engagement with the main body of the second connector and the contacting protrusion of the second connector maintains engagement with the main body of the first connector.

2. The electrical connector assembly as defined in claim 1, wherein in each connector, the electrical terminal is partially disposed in a recess in the respective support.

3. The electrical connector assembly as defined in claim 2, wherein in each connector, the electrical terminal partially passes through a portion of the respective support such that an end portion of the respective electrical terminal extends outwardly from the respective connector.

4. The electrical connector assembly as defined in claim 1. wherein each contact arm is curved.

5. The electrical connector assembly as defined in claim 4, wherein each slot is curved.

6. The electrical connector assembly as defined in claim 1, wherein each support has a first surface on which the electrical contact is seated, a second opposite surface, and an outer wall extending between the surfaces, and wherein a portion of the outer wall of each support follows an arcuate shape.

7. The electrical connector assembly as defined in claim 6, wherein each contact arm is curved.

8. The electrical connector assembly as defined in claim 7, wherein each slot is curved.

9. The electrical connector assembly as defined in claim 6, wherein each second surface is planar.

10. The electrical connector assembly as defined in claim 1, further comprising:

a third connector and a fourth connector, the connectors being hermaphroditic, each connector including a conductive electrical terminal and a non-conductive support on which the electrical terminal is disposed, the electrical terminal including a main body and a contact arm extending therefrom, and a contacting protrusion extending from the contact arm, wherein the contact arm can be flexed relative to the main body, the support having a slot therethrough, the contact arm being proximate to the slot such that the contact arm can be flexed into the slot; and the hinge pin extending through the third and fourth connectors, the third and fourth connectors being rotatable around the hinge pin, wherein when the third connector is mated with the fourth connector, the contacting protrusion of the third connector engages with the main body of the fourth connector and the contacting protrusion of the fourth connector engages with the main body of the third connector, and wherein during rotation of the connectors relative to each other, the contacting protrusion of the third connector maintains engagement with the main body of the fourth connector and the contacting protrusion of the fourth connector maintains engagement with the main body of the third connector.

11. The electrical connector assembly as defined in claim 10, wherein each contact arm is curved.

12. The electrical connector assembly as defined in claim 11, wherein each slot is curved.

13. A device comprising:

a first part having a first electrical component;

a second part having a second electrical component; and an electrical connector assembly that provides an electrical connection between the first and second electrical components while allowing the first and second parts to rotate relative to each other, the electrical connector assembly comprising:

a first connector and a second connector, the connectors being hermaphroditic, each connector including a conductive electrical terminal and a non-conductive support on which the electrical terminal is disposed, the electrical terminal including a main body and a contact arm extending therefrom, and a contacting protrusion extending from the contact arm, wherein the contact arm can be flexed relative to the main body, the support having a slot therethrough, the contact arm being proximate to the slot such that the contact arm can be flexed into the slot, the first connector being electrically connected to the first electrical component, and the second connector being electrically connected to the second electrical component; and a hinge pin extending through the connectors, the connectors being rotatable around the hinge pin, wherein when the first connector is mated with the second connector, the contacting protrusion of the first connector engages with the main body of the second connector and the contacting protrusion of the second connector engages with the main body of the first connector, and wherein during rotation of the connectors relative to each other, the contacting protrusion of the first connector maintains engagement with the main body of the second connector and the contacting protrusion of the second connector maintains engagement with the main body of the first connector.

14. The device as defined in claim 13, wherein in each connector, the electrical terminal is partially disposed in a recess in the respective support.

15. The device as defined in claim 14, wherein in each connector, the electrical terminal partially passes through a portion of the respective support such that an end portion of the respective electrical terminal extends outwardly from the respective connector.

16. The device as defined in claim 13, wherein each connector includes at least one wall forming a recess in which the electrical terminal is mounted.

17. The device as defined in claim 13, wherein each contact arm is curved.

18. The device as defined in claim 17, wherein each slot is curved.

19. The device as defined in claim 13, further comprising:

a third connector and a fourth connector, the connectors being hermaphroditic, each connector including a conductive electrical terminal and a non-conductive support on which the electrical terminal is disposed, the electrical terminal including a main body and a contact arm extending therefrom, and a contacting protrusion extending from the contact arm, wherein the contact arm can be flexed relative to the main body, the support having a slot therethrough, the contact arm being proximate to the slot such that the contact arm can be flexed into the slot, the third connector being electrically connected to the first electrical component, and the fourth connector being electrically connected to the second electrical component; and the hinge pin extending through the third and fourth connectors, the third and fourth connectors being rotatable around the hinge pin, wherein when the third connector is mated with the fourth connector, the contacting protrusion of the third connector engages with the main body of the fourth connector and the contacting protrusion of the fourth connector engages with the main body of the third connector, and wherein during rotation of the connectors relative to each other, the contacting protrusion of the third connector maintains engagement with the main body of the fourth connector and the contacting protrusion of the fourth connector maintains engagement with the main body of the third connector.

20. The device as defined in claim 13, wherein the device is augmented eyewear, wherein the first part is an eye-piece part, wherein the first electrical component is a display device associated with the eye-piece part, wherein the second part is an arm-piece part, and wherein the second electrical component is provided on the arm-piece part and is configured to drive the display device.

* * * * *